US008987152B2

(12) United States Patent
Bornemann et al.

(10) Patent No.: US 8,987,152 B2
(45) Date of Patent: Mar. 24, 2015

(54) POLYMER FIBER AND NONWOVEN

(75) Inventors: Steffen Bornemann, Klein Ilsede (DE); Markus Haberer, Osnabrück (DE)

(73) Assignee: Fitesa Germany GmbH, Peine (DE)

( * ) Notice: Subject to any disclaimer, the term of this patent is extended or adjusted under 35 U.S.C. 154(b) by 0 days.

(21) Appl. No.: 12/258,811

(22) Filed: Oct. 27, 2008

(65) Prior Publication Data

US 2009/0104831 A1 Apr. 23, 2009

Related U.S. Application Data

(63) Continuation of application No. PCT/EP2007/003415, filed on Apr. 19, 2007.

(51) Int. Cl.

| | |
|---|---|
| ***D04H 3/007*** | (2012.01) |
| ***D04H 1/00*** | (2006.01) |
| ***C08K 3/00*** | (2006.01) |
| ***D04H 1/42*** | (2012.01) |
| ***D01F 1/10*** | (2006.01) |
| ***D04H 1/4291*** | (2012.01) |
| ***D04H 3/02*** | (2006.01) |
| ***D04H 3/16*** | (2006.01) |

(52) U.S. Cl.

CPC .. *D04H 1/42* (2013.01); *D01F 1/10* (2013.01); *D04H 1/4291* (2013.01); *D04H 3/007* (2013.01); *D04H 3/02* (2013.01); *D04H 3/16* (2013.01)

USPC ..... 442/417; 428/364; 428/372; 524/424; 524/570

(58) Field of Classification Search

USPC ..... 442/79, 417; 524/424, 570, 599, 582, 524/571, 609; 428/372; 264/103

See application file for complete search history.

(56) References Cited

U.S. PATENT DOCUMENTS

| | | | | |
|---|---|---|---|---|
| 3,692,618 | A | 9/1972 | Dorschner et al. | |
| 5,032,329 | A | 7/1991 | Reifenhauser | |
| 5,609,809 | A | 3/1997 | Tanaka et al. | |
| 5,626,960 | A | 5/1997 | Carney | |
| 6,797,377 | B1 | 9/2004 | DeLucia et al. | |
| 2003/0203695 | A1 * | 10/2003 | Polanco et al. | 442/365 |
| 2004/0152387 | A1 * | 8/2004 | Rudisill et al. | 442/402 |
| 2004/0248486 | A1 * | 12/2004 | Hodson | 442/79 |
| 2006/0076106 | A1 * | 4/2006 | McGuire | 156/272.2 |
| 2006/0084346 | A1 | 4/2006 | Rollin et al. | |
| 2009/0104831 | A1 | 4/2009 | Bornemann et al. | |

FOREIGN PATENT DOCUMENTS

| | | | |
|---|---|---|---|
| DE | 20 63 933 | C3 | 7/1971 |
| DE | 25 31 963 | C3 | 6/1976 |
| DE | 692 25 172 | T2 | 4/1998 |
| DE | 697 07 838 | T2 | 10/2001 |
| DE | 697 27 766 | T2 | 2/2004 |
| EP | 0 298 767 | A2 | 1/1989 |
| EP | 0 841 415 | A2 | 5/1998 |
| WO | WO97/30199 | * | 8/1997 |
| WO | WO 97/30199 | | 8/1997 |
| WO | WO 98/16672 AI | | 4/1998 |
| WO | WO 02/063087 | | 8/2002 |
| WO | WO 03/038174 | | 5/2003 |

OTHER PUBLICATIONS

International Search Report from PCT/EP2007/003415, filed Apr. 19, 2007.

Satoshi Nago, et al.: "Microporous Polypropylene Fibers Containing CaCo3 Fillers"; Journal of Applied Polymer Science; vol. 62, pp. 81-86 (1996).

Notice of Opposition of Application No. EP07724352.5 dated Dec. 10, 2010.

* cited by examiner

*Primary Examiner* — Jeremy R Pierce

*Assistant Examiner* — Ricardo E Lopez

(74) *Attorney, Agent, or Firm* — Alston & Bird LLP

(57) ABSTRACT

A polymer fiber comprising a thermoplastic polymer and an inorganic filler, wherein the filler content, based on the polymer fiber, is more than about 10% by weight and the mean particle size ($D_{50}$) of the filler is less than or equal to about 6 μm. A textile fabric, especially nonwoven, produced from the polymer fiber.

8 Claims, No Drawings

POLYMER FIBER AND NONWOVEN

CROSS REFERENCE TO RELATED APPLICATIONS

This application is a continuation of International Application No. PCT/EP2007/003415, filed Apr. 19, 2007, which claims priority from German patent application 10 2006 020 488.3, filed Apr. 28, 2006.

FIELD OF THE INVENTION

The invention concerns a polymer fiber, containing a thermoplastic polymer and an inorganic filler. The polymer fiber is proposed for the production of textile fabrics, especially nonwovens.

BACKGROUND OF THE INVENTION

Production of polymer fiber for nonwoven production with the addition of inactive mineral fillers is known, in principle, from the prior art.

U.S. Pat. No. 6,797,377 B1 describes a method for production of a cloth from a polymer or polymer mixture with cloth-like structure ("cloth-like properties"), which contains a mineral filler content of up to 10%. To guarantee softness of the fabric with increasing filler content, a filler mixture is used. It was found that the addition of $TiO_2$, in particular, prevents an increased stiffening of the fabric at higher filler contents. According to the teachings of U.S. Pat. No. 6,797,377, a mixture of $TiO_2$ and another mineral filler is therefore exclusively used. A size from 10 to 150 μm is proposed in U.S. Pat. No. 6,797,377 with reference to particle size of the filler.

U.S. Pat. No. 6,797,377 makes no mention of the cloth properties, when the filler content is increased and the addition of $TiO_2$ is simultaneously abandoned. The significance of particle size and particle shape for the properties of the end product at higher filler content is also not disclosed.

SUMMARY OF THE INVENTION

Against this background, the task of the invention consists of the preparation of a polymer fiber with a higher filler content, in which a nonwoven produced from the polymer fiber, in comparison with a polymer fiber with a filler content of less than 10 wt %, is to have essentially unchanged properties. The air permeability, the water column, the average pore size, the penetration times, as well as mechanical properties, measured as maximum tensile stress and maximum tensile elongation, are examples of those nonwoven properties that remain essentially unchanged at the filler content according to the invention.

To solve the task, the invention teaches a polymer fiber, containing a thermoplastic polymer and an inorganic filler, characterized by the fact that the filler content, referred to the polymer fiber, is more than about 10 wt %, and the average particle size (D50) of the filler is less than or equal to 6 μm.

The key idea of the invention consists of the finding that with a significant increase in filler content, the particle size of the filler plays a critical role in guaranteeing constant properties of the polymer fiber and the nonwovens produced from it.

The inventors have thereby recognized that with increased filler content, mostly uniform dispersal of the filler in the polymer matrix guarantees constancy of the fabric properties, and they recognize that the uniformity of dispersal is essentially dependent on the size and shape of the particles of the filler. The range of suitable average particle size was determined for the increased filler content. At a filler content of more than 10 wt %, this lies at <6 μm (D50).

Before describing the preferred embodiments of the polymer fiber according to the invention, the general terms used to describe the invention will first be explained briefly for clarification and presented in relation to the invention:

TERMS

A "fiber" [Faden—also "thread"] according to the invention is a linear structure that forms the base element of a textile fabric. The term "fiber" [Faden] is therefore to be understood as a common general term for the terms "filament" and "fiber" [Faser]. A "fiber" [Faser] differs conceptually from a "filament" by its finite length. "Filaments" are therefore to be understood as endless fibers [Fasern].

"Polymers" are macromolecular substances, constructed from simple molecules (monomers) by polymerization, polycondensation or polyaddition.

"Fiber-forming polymers" according to the invention are polymers that have properties in their melt or solution that have qualities that satisfy the conditions of spinnability. The conditions for spinnability of polymers were described by Nitschman and Schrade (Helv. Chem. Acta 31 (1948) 297) and by Hirai (Rheol. Acta 1 (1958) 213), as well as by Ziabicki and Taskerman-Krozer (Kolloid Z. 198 (1964) 60).

A "filler" according to the invention concerns particles and other forms of materials that can be added to the polymer extrusion mixture, in which the particles do not adversely affect the polymer and are uniformly distributed in the extrusion mixture. The filler can consist of different materials, in which variation possibilities also exist with respect to shape and size of the particles.

"Textile fabrics" in the context of this description are woven, warp-knit, knit fabrics, lays or nonwovens. "Nonwovens" are therefore a subtype of textile fabrics. They consist of fiber webs, which are bonded for example by mechanical methods or by binding fibers or chemical auxiliaries or their combinations.

DETAILED DESCRIPTION

Embodiments of the present invention are directed to polymer fibers comprising a thermoplastic polymer and an inorganic filler wherein the filler content, based on the polymer fiber, is greater than about 10 wt %, and the average particle size ($D_{50}$) of the filler is equal to or less than about 6 μm.

In a preferred embodiment, the filler of the polymer fiber according to the invention consists of an alkaline earth carbonate, especially calcium carbonate. Calcium carbonate is an ideal filler, which is characterized, among other things, by the following properties described by J. T. Lutz and R. F. Grossman (Editors), "Polymer modifiers and additives," Marcel Dekker, Inc. 2001, page 125 ff.: chemically inert relative to the polymer or other additives; low specific density; desired refractive index and color; low costs.

It should be borne in mind that calcium carbonate is normally obtained from natural chalk deposits, and that local geological conditions dictate the content of additional minerals in the chalk. Thus metal oxides, like iron oxide, can also be contained in chalk, for example, in addition to other alkaline earth carbonates.

The use of different alkaline earth carbonates or a mixture of two or more of these compounds is naturally also conceivable. Calcium carbonate ($CaCO_3$) or magnesium carbonate ($MgCO_3$) or barium carbonate (BaCO3) are proposed, in particular. The filler thus consists of at least 90 wt %, preferably 95 wt %, and especially 97 wt % calcium carbonate.

Additional fillers, one or more of which are usable with or without an alkaline earth carbonate, include iron oxides, aluminum oxide ($Al_2O_3$) or silicon dioxide ($SiO_2$) or calcium oxide (CaO) or magnesium oxide (MgO) or barium sulfate ($BaSO_4$) or magnesium sulfate ($MgSO_4$) or aluminum sulfates ($AlSO_4$) or aluminum hydroxide ($AlOH_3$). Clays (kaolin), zeolites, kieselguhr, talc, mica or carbon black are also considered.

Titanium dioxide ($TiO_2$) is a common filler, which can also be used, in principle, in conjunction with the invention. However, it was surprisingly shown that, at higher calcium carbonate contents, the addition of the matting agent titanium dioxide ($TiO_2$) can be fully dispensed with. This circumstance is worth noting with respect to the task of the present invention, because titanium dioxide is more expensive than calcium carbonate and an additional cost advantage is therefore gained.

In the particularly preferred embodiments of the polymer fiber according to the invention, the filler content, referred to the weight of the polymer fiber, is between 15 and 25 wt %.

With reference to particle size, the preferred range of fillers used according to the invention lies at <6 μm. This preferably corresponds to a top cup (D98) of the filler particles of <10 μm. The value in this case states that only 2% of the filler particles are >10 μm.

In a particularly preferred embodiment, the particle size lies at 2-6 μm. The mentioned lower limit makes no assertion concerning performability of the invention at even smaller particle sizes, but rather characterizes the range of those particle sizes that guarantee a uniform dispersal and, at the same time, are available at favorable introductory prices.

With reference to particle shape of the fillers a distinction is made between spherical (for example, glass or silicate spheres), cubic (for example, calcium carbonate), cuboid (for example, barium sulfate or silica), tabular (for example, talc or mica) or cylindrically shaped particles.

For production of the polymer fiber according to the invention, generally all thermoplastic compounds are considered. The important fiber-forming, spinnable thermoplastic polymers are polyolefins, polyesters, polyamides or halogen-containing polymers.

The class of polyolefins includes, among others, polyethylene (HDPE, LDPE, LLDPE, VLDPE; ULDPE, UHMWPE), polypropylene (PP), poly(1-butene), polyisobutylene, poly(1-pentene), poly(4-methylpent-1-ene), polybutadiene, polyisoprene, as well as different olefin copolymers. In addition to these, heterophase blends are also included in the polyolefins. For example, polyolefins, especially polypropylene or polyethylene, graft or copolymers made of polyolefins and α,β-unsaturated carboxylic acid or carboxylic acid anhydrides, polyesters, polycarbonate, polysulfone, polyphenylene sulfide, polystyrene, polyamides or a mixture of two or more of the mentioned compounds, can be used.

The polyesters include polyethylene terephthalate (PET), polytrimethylene terephthalate (PTT), polybutylene terephthalate (PBT), polyethylene aphthalate (PEN), but also degradable polyesters, like polylactic acid (polylactide, PLA).

The halogen-containing fiber-forming polymers include polyvinylchloride (PVC), polyvinylidene chloride (PVDC), polyvinylidene fluoride (PVDF) and polytetrafluoroethylene (PTFE).

In addition to the already mentioned fiber-forming synthetic polymers, there are other polymers, like polyacrylates, polyvinyl acetate, polyvinyl alcohol, polycarbonate, polyurethane, polystyrene, polyphenylene sulfide, polysulfone, polyoxymethylene, polyimide or polyurea, for example, which can be considered as a component of the polymer fiber according to the invention.

In further preferred embodiments, the polymer fiber according to the invention can be constructed as mono- or multicomponent filament. The polymer composition of the individual components then need not be uniform, but is variable over broad limits. In a particularly preferred embodiment, the weight percent of the filler-containing components, referred to the total weight of the multicomponent filament, is greater than 50%.

When bicomponent filaments are used, different forms work, for example, core/shell or side-to-side. Bicomponent filaments made of different polyolefins, especially polypropylene or polyethylene, are particularly preferred.

For production of polymer filaments, in addition to the use of round fibers, different other cross-sections also work. Particularly preferred are monofilaments, whose cross-sectional shape is round, oval or n-gonal, in which n is greater than or equal to 3, for example, trilobal cross-sectional shapes. Fibers [Faser] with a hollow cross-section are also considered.

The polymer fibers according to the invention can be produced according to known methods. The following steps are used here:

i Mixing of polymer granulate with the particles of a filler, ii Extrusion of the mixture through one or more spinnerets, iii Taking off the formed polymer fiber, iv Optionally stretching and/or relaxation of the formed filament, and v Winding of the fiber, in which the filler content, referred to the polymer fiber, is >10 wt %, and the average particle size ($D_{50}$) of the filler is <6 μm.

In the production of "spun nonwovens" from synthetic polymers by melt spinning, the polymer melt is forced through nozzle openings with pressure pumps and taken off in the form of filaments. Ordinary melt spinning technologies are described, for example, in U.S. Pat. No. 3,692,618 (Metallgesellschaft AG), U.S. Pat. No. 5,032,329 (Reifenhaüser), WO03038174 (BBA Nonwovens, Inc.) or WO02063087 (Ason).

By stretching the withdrawn filaments, for example, by means of compressed air and/or partial vacuum and/or stretching cylinders, the macromolecules are ordered in the filaments, in which the filament acquires its physical properties (strength, fineness, shrinkage properties). After stretching, the filaments are placed on a support for further bonding to a nonwoven, or cut to the length desired for the spinning fiber production (filaments, after stretching, are sometimes referred to as fibers [Faser] in the literature, although cutting of the filaments to length has not yet occurred). Bonding of the filaments during melt spinning can occur in ways known to one skilled in the art by mechanical methods (mostly needling or water jet bonding), by means of heat (welding, using pressure with simultaneous heating) or by means of chemical methods (binders). In addition to the preferred melt spinning, the carding method, the melt-blow method, the wet nonwoven method, electrostatic spinning or the aerodynamic nonwoven production method can be used as methods for nonwoven production.

The fabrics according to the invention, especially nonwovens, can also be produced according to the above-mentioned methods. Before extrusion of the filament, addition of a filler in the mentioned amount and particle size occurs. The following steps are then used:

i Mixing of polymer granulate with the particles of the filler, ii Extrusion of the mixture through one or more spinnerets, iii Taking off the formed polymer fiber, iv Optionally stretching and/or relaxation of the formed filament, and v Winding of the fiber for nonwoven production, in which the filler content, referred to the polymer fiber, is >10 wt %, and the average particle size (D50) of the filler is <6 μm.

Textile fabrics from polyolefin fibers, especially polypropylene fibers and/or polypropylene-polyethylene bicomponent fibers, especially core-shell fibers with a PP core and a PE shell, are used with particular preference. These products are characterized by high stability relative to chemically aggressive environments, in addition to a favorable price. In a preferred embodiment, the textile fabric consists of a blend of polymer fiber with a uniform or several different natural fibers. Hemp, jute, sisal and tobacco leaves are used as natural fibers, for example.

Further optimization of the nonwoven according to the invention in its bonding, for example, by variation of temperatures and pressures during thermal bonding during calendering, can certainly contribute to the fact that the properties of the nonwovens filled with calcium carbonate can be varied beyond the scope mentioned here.

The nonwoven produced according to the invention is more precisely defined by the following characteristics in the stated limits:

Basis weight of 7 and 500 g/m$^2$, preferably between 10 and 200 g/m$^2$.

Product from a basis weight (g/m$^2$) and air permeability (1/m$^2$s, according to DIN EN ISO 9237) in the range of 110,000±20%.

Values for the ratios from water column (according to DIN EN 20811) and basis weight of 2.5±20%.

The hydrophilized filament surface has strike-through times according to EDANA ERT 150 values of less than 5 seconds.

Values for the ratio of maximum tensile stress (according to DIN 29073-3) and basis weight in the machine direction of 1.7±20%, as well as in the cross direction of 1.0±20%.

Values for the ratios from maximum tensile elongation (according to DIN 29073-3) and basis weight in the machine direction of 3.3±20%, as well as in the cross direction of 4.0±20%.

Filament titers in the range of 1 to 5 dtex, preferably 2 to 3.5 dtex.

The numerous application possibilities of the nonwoven also lie within the context of the invention. The most important application possibilities for the nonwoven according to the invention are production of insert materials, personal hygiene articles (diapers, sanitary napkins, cosmetic pads), dust cloths and mop cloths, as well as filters for gases, aerosols and liquids, bandages and wound compresses. Production of insulation materials, acoustic nonwovens and roof truss blankets is also conceivable.

The application area for so-called geotextiles is very extensive, corresponding to the scope of the general term. Geotextiles are used, for example, in the strengthening of dikes, as a layer in roof vegetation structures, as a layer in landfill covers for separation of earth layers and bed material or as an intermediate layer beneath the ballast bed of street pavement. Nonwovens can also be beneficially used in agriculture and horticulture as covers for field crops and vegetables.

EXAMPLES

Additional details and features of the invention will be further explained below by means of practical examples. The examples, however, are not meant to restrict the invention, but merely to explain it.

Example 1

Nonwovens Consisting of Monofilaments

PP spun nonwovens with different calcium carbonate content and different basis weight were produced on a conventional spun nonwoven pilot plant (Reicofil 3). The employed calcium carbonate (Omyalene 102M-OG) is a granulated calcium carbonate, which can be ordered from Omya AG.

As starting material for production of the nonwovens, a PP, produced using Ziegler-Natta catalysis, was chosen (ZN-PP: Moplen HP560R; manufacturer Basell), in which the presented method is not restricted to this PP type, but instead other plastics suitable for fiber [Faser], filament or nonwoven formation are also suited, like metallocene-PP, statistical and heterophase propylene copolymers, polyolefin block polymers and polyolefin block copolymers, polyethylenes, polyesters, polyamides, etc.

Table 1 summarizes a composition of the produced nonwovens, as well as selected characteristic properties.

The nonwoven samples 12.1, 17.1 and 20.1, consisting of pure PP monofilaments and produced by melt spinning, serve as reference.

The nonwoven samples 12.2, 17.2 and 20.2, produced by melt spinning, were produced from monofilaments, consisting of a mixture of 90% PP and 10% calcium carbonate.

The nonwoven samples 12.3, 17.3 and 20.3, produced by melt spinning, were produced from monofilaments, consisting of a mixture of 85% PP and 15% calcium carbonate.

TABLE 1

Composition, process conditions and characteristic properties of the nonwovens produced from monofilaments.

| | Pure PP - Nonwoven | | | PP Nonwoven filled with calcium carbonate | | | | | |
|---|---|---|---|---|---|---|---|---|---|
| | Sample 12.1 | Sample 17.1 | Sample 20.1 | Sample 12.2 | Sample 17.2 | Sample 20.2 | Sample 12.3 | Sample 17.3 | Sample 20.3 |
| Composition | | | | | | | | | |
| PP | 100 | 100 | 100 | 90 | 90 | 90 | 85 | 85 | 85 |
| Omyalene | 0 | 0 | 0 | 10 | 10 | 10 | 15 | 15 | 15 |

TABLE 1-continued

Composition, process conditions and characteristic properties of the nonwovens produced from monofilaments.

| | | | | | | | | | | |
|---|---|---|---|---|---|---|---|---|---|---|
| Process temperatures | | | | | | | | | | |
| Extruder input | ° C. | 180 | 180 | 180 | 180 | 180 | 180 | 180 | 180 | 180 |
| Extruder head | ° C. | 230 | 230 | 230 | 230 | 230 | 230 | 230 | 230 | 230 |
| Spinneret | ° C. | 235 | 235 | 235 | 235 | 235 | 235 | 235 | 235 | 235 |
| Calendar Oil Temperature | ° C. | 150 | 150 | 150 | 150 | 150 | 150 | 150 | 150 | 150 |
| Calendar Pressure | N/mm | 70 | 70 | 70 | 70 | 70 | 70 | 70 | 70 | 70 |
| Filament Properties | | | | | | | | | | |
| Titer | µm | 18.1 | 18.8 | 19.2 | 18.3 | 18.6 | 19.1 | 17.3 | 18.2 | 19.0 |
| | STD | 1.21 | 0.64 | 0.77 | 0.90 | 1.00 | 0.59 | 0.77 | 0.81 | 0.85 |
| Titer | dtex | 2.4 | 2.5 | 2.6 | 2.9 | 3.0 | 3.1 | 2.8 | 3.1 | 3.3 |
| | STD | 0.31 | 0.17 | 0.21 | 0.28 | 0.31 | 0.19 | 0.24 | 0.27 | 0.30 |
| Nonwoven Characteristics | | | | | | | | | | |
| Basic Weight | $g/m^2$ | 12.1 | 17.5 | 20.4 | 11.7 | 16.8 | 21.4 | 11.9 | 17.5 | 22.1 |
| | STD | 0.66 | 0.80 | 0.56 | 0.59 | 0.51 | 0.67 | 0.40 | 0.57 | 0.63 |
| Nonwoven Thickness | µm | 216.0 | 279.0 | 312.5 | 216.5 | 70.5 | 303.0 | 204.5 | 269.0 | 303.5 |
| | STD | 12.4 | 10.7 | 11.8 | 20.0 | 9.3 | 17.8 | 16.2 | 13.5 | 10.0 |
| Nonwoven Density | $g/cm^3$ | 0.056 | 0.063 | 0.065 | 0.054 | 0.062 | 0.071 | 0.058 | 0.065 | 0.073 |
| | STD | — | — | — | — | — | — | — | — | — |
| Barrier Properties of Nonwoven | | | | | | | | | | |
| Average Pore | µm | — | 113 | 114 | 164 | 121 | 103 | — | 125 | 115 |
| | STD | — | 3.4 | 13.1 | 15.8 | 2.5 | 8.3 | — | 6.4 | 7.0 |
| Air Permeability | $l/m^2s$ | 8.880 | 6.610 | 5.763 | 9.090 | 6.950 | 5.932 | 9.470 | 7.010 | 5.530 |
| | STD | 537 | 409 | 361 | 644 | 489 | 433 | 878 | 546 | 378 |
| Water Column | cm | 5.5 | 6.7 | 8.4 | 4.4 | 6.8 | 8.9 | 3.6 | 6.9 | 9.0 |
| | STD | 0.8 | 1.0 | 1.2 | 0.8 | 0.6 | 0.6 | 0.8 | 0.7 | 0.9 |
| Mechanical Nonwoven Properties | | | | | | | | | | |
| Maximum Tensile Stress MD | N/5 mm | 18.5 | 31.9 | 40.6 | 18.7 | 27.2 | 35.2 | 16.8 | 25.4 | 34.0 |
| | STD | 3.18 | 1.85 | 2.72 | 2.37 | 2.22 | 1.85 | 1.79 | 2.88 | 3.21 |
| Maximum Tensile Stress CD | N/5 mm | 12.3 | 21.3 | 25.8 | 10.5 | 18.8 | 23.8 | 9.2 | 16.0 | 21.8 |
| | STD | 1.57 | 1.39 | 2.37 | 0.99 | 1.42 | 2.44 | 1.86 | 2.48 | 1.90 |
| Maximum Tensile Elongation MD | % | 41.5 | 60.6 | 64.6 | 47.3 | 57.1 | 57.4 | 46.9 | 56.6 | 59.7 |
| | STD | 10.35 | 7.08 | 6.90 | 9.56 | 7.09 | 6.11 | 5.52 | 8.95 | 9.07 |
| Maximum Tensile Elongation CD | % | 54.1 | 64.8 | 67.0 | 64.5 | 66.8 | 68.0 | 60.3 | 59.9 | 65.1 |
| | STD | 8.66 | 7.85 | 6.82 | 8.14 | 7.36 | 9.37 | 13.89 | 8.43 | 6.61 |
| Wettability | | | | | | | | | | |
| Penetration Time | STD | 4.3 | — | 3.1 | 3.5 | — | 3.8 | — | — | — |

| | | PP Nonwoven filled with Calcium Carbonate | |
|---|---|---|---|
| | | Sample 17.4 | Sample 20.4 |
| Composition | | | |
| PP | | 75 | 75 |
| Omyalene | | 25 | 25 |
| Process Temperatures | | | |
| Extruder Input | ° C. | 180 | 180 |
| Extruder Head | ° C. | 230 | 230 |
| Spinneret | ° C. | 235 | 235 |
| Calendar Oil Temperature | ° C. | 150 | 150 |
| Calendar Pressure | N/mm | 70 | 70 |
| Filament Properties | | | |
| Titer | µm | 19.0 | 19.0 |
| | STD | 1.3 | 1.3 |
| Titer | dtex | 3.8 | 3.8 |
| | STD | 0.052 | 0.052 |
| Nonwoven Characteristics | | | |
| Basis Weight | $g/m^2$ | 16.7 | 20.0 |
| | STD | 0.5 | 0.63 |
| Nonwoven Thickness | µm | 253.5 | 287.0 |
| | STD | 9.1 | 9.5 |
| Nonwoven Density | $g/cm^3$ | 0.66 | 0.70 |
| | STD | — | — |

TABLE 1-continued

| Composition, process conditions and characteristic properties of the nonwovens produced from monofilaments. | | | |
|---|---|---|---|
| Barrier Properties of Nonwoven | | | |
| Average Pore | μm | 143 | 131 |
| | STD | 0.4 | 12.6 |
| Air Permeability | $l/m^2s$ | 7.730 | 6.650 |
| | STD | 412 | 250 |
| Water Column | cm | 7.0 | 8.2 |
| | STD | 0.4 | 1.3 |
| Mechanical Nonwoven Properties | | | |
| Maximum Tensile Stress MD | N/5 mm | 29.6 | 35.7 |
| | STD | 2.32 | 2.57 |
| Maximum Tensile Stress CD | N/5 mm | 16.7 | 20.4 |
| | STD | 1.97 | 1.11 |
| Maximum Tensile Elongation MD | % | 63.4 | 70.4 |
| | STD | 9.15 | 9.14 |
| Maximum Tensile Elongation CD | % | 73.3 | 73.9 |
| | STD | 9.32 | 4.75 |

The nonwoven samples 12.4 and 20.4, produced by melt spinning, were produced from monofilaments, consisting of a mixture of 75% PP and 25% calcium carbonate.

Example 2

Nonwovens Consisting of Bicomponent Fibers

Since other fiber [Faser] forms are conceivable, in addition to the method presented here, multicomponent fibers [Fasern] for the production of nonwovens were spun, in which the calcium carbonate is not distributed in the entire fiber, but rather only in individual fiber [Faser] components.

Nonwovens from core/shell bicomponent fibers were produced as examples.

Table 2 summarizes the composition, as well as its characteristic properties.

The nonwoven samples 12.1B and 20.1B, produced by melt spinning, consist of pure PP bicomponent filaments with a core/shell ratio of 50/50 and are to serve as a reference.

The nonwoven samples 12.2B and 20.2B, produced by melt spinning, consist of PP bicomponent filaments, in which the core of the filaments consists of a mixture of 90% PP and 10% calcium carbonate, and the shell consists of pure PP. The core/shell ratio was 75/25. Referred to the entire fiber [Faser], the calcium carbonate content is about 7.5%.

The nonwoven samples 12.3B and 20.3B, produced by melt spinning, consist of PP bicomponent filaments, in which both the core and shell of the filaments consist of a mixture of 90% PP and 10% calcium carbonate. The core/shell ratio was 50/50. Referred to the entire fiber [Faser], the calcium carbonate content is about 5%.

The nonwoven sample 20.4B, produced by melt spinning, consists of PP bicomponent filaments, in which the core of the filaments consist of a mixture of 75% PP and 25% calcium carbonate and the shell consists of pure PP. The core/shell ratio was 50/50. Referred to the entire fiber [Faser], the content of calcium carbonate is about 12.5%.

The nonwoven sample 20.5B, produced by melt spinning, consists of PP bicomponent filaments, in which the core of the filaments consist of a mixture of 75% PP and 25% calcium carbonate and the shell consists of pure PP. The core/shell ratio was 75/25. Referred to the entire fiber [Faser], the content of calcium carbonate is about 18.75%.

TABLE 2

| Composition, process conditions and characteristic properties of the nonwovens produced from bicomponent fibers. | | | | | | | | | |
|---|---|---|---|---|---|---|---|---|---|
| | | Pure PP - Nonwovens | | Nonwovens filled with calcium carbonate | | | | | |
| | | Sample 12.1B | Sample 20.1B | Sample 12.2B | Sample 20.2B | Sample 12.3B | Sample 20.3B | Sample 20.4B | Sample 20.5B |
| Shell/Core Ratio | | 50/50 | 50/50 | 25/75 | 25/75 | 50/50 | 50/50 | 50/50 | 25/75 |
| Core Composition | | | | | | | | | |
| PP | | 100 | 100 | 90 | 90 | 90 | 90 | 75 | 75 |
| Omyalene | | 0 | 0 | 10 | 10 | 10 | 10 | 25 | 25 |
| Shell Composition | | | | | | | | | |
| PP | | 100 | 100 | 100 | 100 | 90 | 90 | 100 | 100 |
| Omyalene | | 0 | 0 | 0 | 0 | 10 | 10 | 0 | 0 |
| Process Temperature | | | | | | | | | |
| Extruder 1st Zone | ° C. | 180 | 180 | 180 | 180 | 180 | 180 | 180 | 180 |
| Extruder Head | ° C. | 230 | 230 | 230 | 230 | 230 | 230 | 230 | 230 |
| Spinneret | ° C. | 235 | 235 | 235 | 235 | 235 | 235 | 235 | 235 |
| Calendar Oil Temperature | ° C. | 150 | 150 | 150 | 150 | 150 | 150 | 150 | 150 |
| Calendar Roll Pressure | N/mm | 70 | 70 | 70 | 70 | 70 | 70 | 70 | 70 |

TABLE 2-continued

Composition, process conditions and characteristic properties of the nonwovens produced from bicomponent fibers.

| | | Pure PP - Nonwovens | | Nonwovens filled with calcium carbonate | | | | | |
|---|---|---|---|---|---|---|---|---|---|
| | | Sample 12.1B | Sample 20.1B | Sample 12.2B | Sample 20.2B | Sample 12.3B | Sample 20.3B | Sample 20.4B | Sample 20.5B |
| Filament Properties | | | | | | | | | |
| Titer | μm | 16.9 | 16.5 | 17.3 | 17.3 | 17.1 | 17.1 | 17.1 | 17.0 |
| | STD | 0.41 | 0.90 | 0.93 | 0.47 | 1.05 | 1.15 | 0.38 | 0.57 |
| Titer | dtex | 2.0 | 1.9 | 2.4 | 2.4 | 2.4 | 2.4 | 2.6 | 2.8 |
| | STD | 0.10 | 0.21 | 0.25 | 0.13 | 0.28 | 0.32 | 0.12 | 0.19 |
| Nonwoven Formation | | | | | | | | | |
| Basic Weight | $g/m^2$ | 12.3 | 20.1 | 12.4 | 20.6 | 13.1 | 21.0 | 19.5 | 20.3 |
| | STD | 0.39 | 0.67 | 0.49 | 0.46 | 0.33 | 0.56 | 0.96 | 1.08 |
| Barrier Properties | | | | | | | | | |
| Air Permeability | $l/m^2s$ | 7760 | 5017 | 7988 | 5241 | 7564 | 5017 | 5492 | 5166 |
| | STD | 468 | 270 | 321 | 471 | 467 | 294 | 445 | 313 |
| Mechanical Properties | | | | | | | | | |
| F max MD | N/5 mm | 19.4 | 44.7 | 15.9 | 34.9 | 18.7 | 35.9 | 43.4 | 43.2 |
| | STD | 1.46 | 3.68 | 1.89 | 2.39 | 1.69 | 3.45 | 2.20 | 5.26 |
| F max CD | N/5 mm | 13.4 | 31.8 | 12.3 | 26.0 | 13.9 | 25.7 | 29.0 | 30.7 |
| | STD | 1.30 | 4.22 | 1.95 | 3.52 | 1.48 | 2.26 | 2.26 | 2.60 |
| Elongation MD | % | 37.7 | 66.2 | 39.6 | 53.3 | 42.0 | 59.2 | 64.5 | 63.5 |
| | STD | 6.06 | 6.03 | 7.83 | 7.82 | 3.83 | 9.43 | 6.79 | 11.54 |
| Elongation CD | % | 50.6 | 70.6 | 52.3 | 66.7 | 55.1 | 64.5 | 68.8 | 64.8 |
| | STD | 4.70 | 7.37 | 11.29 | 11.25 | 5.20 | 7.69 | 4.99 | 8.94 |

It is understood that the mixtures for production of nonwovens can also contain other additives or additive mixtures, especially titanium dioxide or pigments, in addition to the mentioned formulas.

The results in Table 1 and 2 show that the addition of calcium carbonate surprisingly causes no noticeable change in the characteristic nonwoven properties.

Example 3

Hydrophilicity after Filler Addition

For hygiene products (for example, diapers), the nonwovens used are generally fitted hydrophilically. For example, the hydrophilization agent Nuwet 237 by the company GE SILICONES can be used here.

To check the hydrophilicity as a function of content of calcium carbonate, both nonwovens made of pure PP and those with a calcium carbonate content of 10% with a basis weight of 12 $g/m^2$ and 20 $g/m^2$ were hydrophilized with a formula consisting of 7.5% Nuwet 237 in water using a Kiss-roll application. The active substance content applied in this way was about 0.2%, referred to the weight of the nonwoven.

For the hydrophilized nonwovens not provided with calcium carbonate, penetration times of 4.3 seconds (12 $g/m^2$) and 3.1 seconds (20 $g/m^2$) were measured. For the hydrophilized nonwovens with a content of 10% calcium carbonate, penetration times of 3.5 seconds (12 $g/m^2$) and 3.8 seconds (20 $g/m^2$) were measured.

It was therefore found that the addition of 10% calcium carbonate has no significant effect on hydrophilic properties.

Methods

Determination of Filament Titer

Determination of the filament titer occurred by means of a microscope. Conversion of the measured titer (in micrometers) to decitex occurred according to the following formula (density PP=0.91 $g/cm^3$):

$$\left(\frac{Titer_{\mu m}}{2}\right)^2 \cdot \pi \cdot \rho \left[\frac{g}{cm^3}\right] \cdot 0,01 = Titer_{dtex}\left[\frac{g}{10^4\ m}\right]$$

Determination of Basis Weight

The basis weight determination occurred according to DIN EN 29073-1 on 10×10 cm test specimens.

The nonwoven thickness was measured as the distance between two plane-parallel measurement surfaces of a certain size, between which the nonwoven is found under a stipulated measurement pressure. The method was carried out according to DIN EN ISO 9703-2. Support weight 125 g, measurement surface 25 $cm^2$, measurement pressure 5 $g/cm^2$.

Determination of Average Pore Size

Determination of the average pore size of the nonwovens occurred by means of a capillary flow porometer (PMI Capillary Flow Porometer CFP-34RUF8A-3-X-M2T). A sample saturated with a special liquid is then exposed in the porometer to a continuously increasing air pressure; the connection between of air pressure and airflow rate is measured.

Determination of Air Permeability

Measurement of air permeability occurred according to DIN EN ISO 9237. The surface of the measurement head was 20 $cm^2$; the applied test pressure was 200 Pa.

Determination of Water Column

Determination of the water column was carried out according to DIN EN 20811. The gradient of the test pressure was 10 mbar/min. As a gauge of water tightness, the water pressure in mbar or mm water column is stated, at which the first water drop penetrates through the test material at the third site of the test surface.

Determination of Mechanical Properties

The mechanical properties of the nonwovens were determined according to DIN EN 29073-3. Tightening length: 100 mm, sample width 50 mm, advance 200 mm/min. The "highest tensile stress" is the maximum achieved stress on passing through the stress-elongation curve; the "highest tensile elongation" is the elongation in the stress-elongation curve pertaining to the highest tensile stress.

Determination of Hydrophilicity

Measurement of the penetration times of the hydrophilized nonwovens ("liquid strike through time") occurred according to EDANA ERT 150.

That which is claimed:

1. Polymer fibers comprising a thermoplastic polymer and an inorganic filler wherein the filler content, based on the polymer fiber, is greater than about 10 wt %, and the average particle size ($D_{50}$) of the filler is equal to or less than about 6 μm, and wherein the filler is an alkaline earth carbonate consisting of at least about 90 wt % calcium carbonate, and wherein the amount of filler having a size less than 10 μm is 98%, wherein the polymer fibers comprise spunbond multicomponent filaments having a core consisting of polypropylene and calcium carbonate particles, and a sheath consisting of polypropylene.

2. Polymer fibers according to claim 1, wherein the filler content, referred to the polymer fiber, is between about 15 and 25 wt %.

3. Polymer fibers according to claim 1, wherein the average particle size of the filler ($D_{50}$) is between 2 μm and 6 μm.

4. Polymer fibers according to claim 1, wherein the weight percentage of components of the filament containing the filler, referred to the weight of the multicomponent filament, is greater than about 50 wt %.

5. A nonwoven fabric of polymer fibers comprising a thermoplastic polymer and an inorganic filler wherein the filler content, based on the polymer fiber, is 25 wt. %, and the average particle size ($D_{50}$) of the filler is equal to or less than about 6 μm, wherein the nonwoven fabric has a basis weight that is from 7 to 500 g/m$^2$, and wherein a product of the basis weight and the air permeability in accordance with DIN EN ISO 9237 is in the range of 88,000 to 132,000 and the value of a quotient of the head water in accordance with DIN EN20811 and the basis weight is in the range from 2 to 3, and wherein the polymer fibers comprise multicomponent filaments comprising a core consisting of polypropylene and calcium carbonate particles, and a sheath consisting of polypropylene.

6. Polymer fibers according to claim 1, wherein the filler content, based on the polymer fiber, is about 25 wt %.

7. A nonwoven fabric comprising a thermoplastic polypropylene and calcium carbonate particles having an average particle size ($D_{50}$) equal to or less than about 6 μm, wherein the amount of calcium carbonate, based on the polymer fiber, is about 25 wt %, and wherein the nonwoven fabric has a basis weight that is from 7 to 500 g/m$^2$, and wherein a product of the basis weight and the air permeability in accordance with DIN EN ISO 9237 is in the range of 88,000 to 132,000 and the value of a quotient of the head water in accordance with DIN EN20811 and the basis weight is in the range from 2 to 3, and wherein the nonwoven fabric comprises bicomponent filaments comprising a core consisting of polypropylene and calcium carbonate particles, and a sheath consisting of polypropylene.

8. The nonwoven fabric of claim 7 wherein the filler is an alkaline earth carbonate consisting of at least 90 wt % calcium carbonate.

* * * * *